US005489093A

United States Patent [19]

Morehead, III

[11] Patent Number: 5,489,093

[45] Date of Patent: Feb. 6, 1996

[54] SHEET GRIPPER FOR A SHEET-PROCESSING MACHINE

[75] Inventor: James C. Morehead, III, Aliquippa, Pa.

[73] Assignee: MAN Roland Drucksmaschinen AG, Germany

[21] Appl. No.: 299,152

[22] Filed: Aug. 31, 1994

[30] Foreign Application Priority Data

Sep. 9, 1993 [DE] Germany ..... 43 30 610.1

[51] Int. Cl.[6] ..... B65H 5/12; B65H 5/14

[52] U.S. Cl. ..... 271/277; 271/82; 101/409

[58] Field of Search ..... 271/277, 204, 271/82, 85; 101/408, 409, 410, 411, 412, 415.1

[56] References Cited

U.S. PATENT DOCUMENTS 2,395,444 2/1946 Belluche .
4,592,279 6/1986 Kemmerer ..... 271/277
5,213,038 5/1993 Takahashi et al. ..... 101/410

FOREIGN PATENT DOCUMENTS 8404981.2 3/1984 Germany .
3623405A1 2/1988 Germany .
917781 12/1958 United Kingdom ..... 101/409

*Primary Examiner*—H. Grant Skaggs
*Attorney, Agent, or Firm*—Leydig, Voit & Mayer, Ltd.

[57] ABSTRACT

In a sheet gripper for a sheet-processing machine, a swingable gripper arm has at one of its ends a gripper tip which can be pressed against an abutment and, at its other end, a spring section which is bent back towards the gripper tip in the manner of a bent leaf spring and connects the gripper arm to a gripper shaft. The gripper arm is of substantially inflexible construction. The bent-back spring section and the gripper tip lie on opposite sides of a plane which extends substantially perpendicular to the gripper arm and radially of the gripper shaft. The bent-back end of the spring section forms an attachment arm which rests, with a contact surface adapted to the curvature of the gripper shaft, on the side of the gripper shaft facing the gripper arm and is releasably attached to the gripper shaft by means of a screw.

11 Claims, 1 Drawing Sheet

FIG. 1
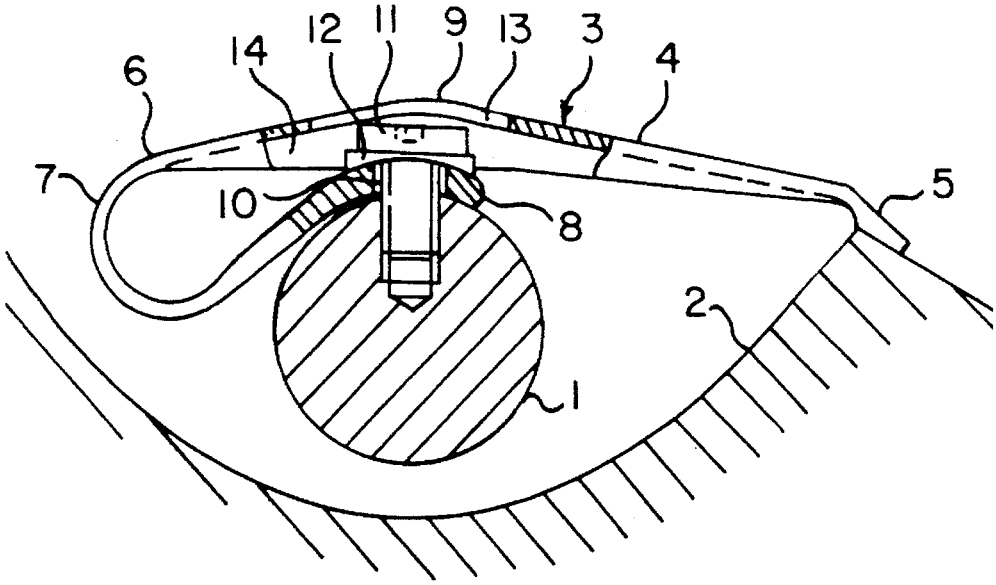
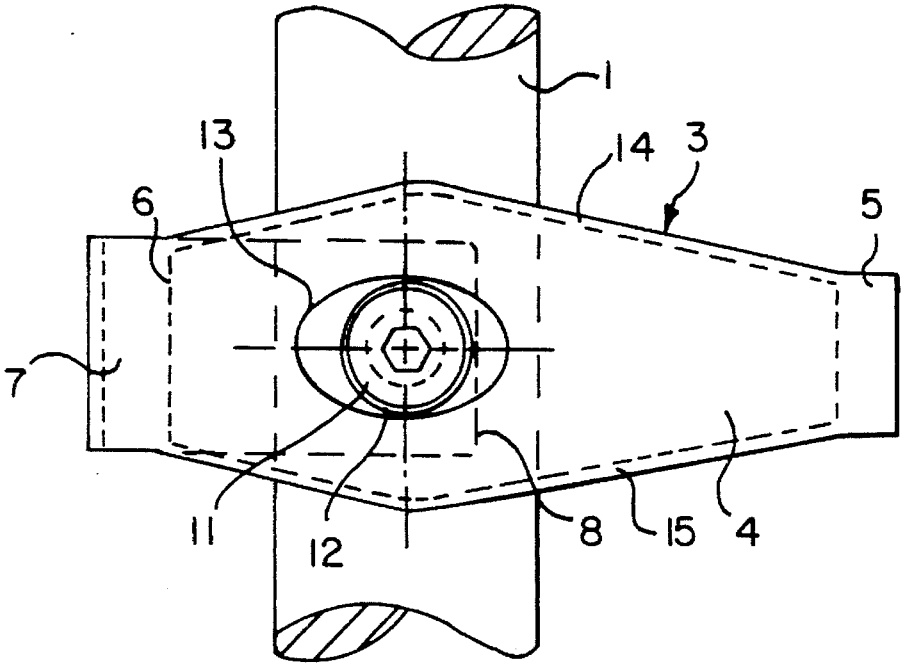
FIG. 2

SHEET GRIPPER FOR A SHEET-PROCESSING MACHINE

BACKGROUND OF THE INVENTION

The invention relates generally to a sheet gripper for a sheet-processing machine and, more particularly, to a sheet gripper having a swingable gripper arm which has at one of its ends a gripper tip that can be pressed against an abutment and, at its other end, a spring section which is bent back towards the gripper tip in the manner of a bent leaf spring and connects the gripper arm to a gripper shaft.

In sheet-fed printing machines the sheets to be printed are transferred from one cylinder to the next by means of sheet grippers in order to transport the sheets from printing unit to printing unit. It is extremely important that satisfactory transfer of the sheets takes place from cylinder-to-cylinder. Only in this way can a good printing quality be insured. For this purpose, the grippers must impose a sufficiently large holding force which amounts to about 10 kp per gripper. The grippers should be as light as possible and not extend a significant distance from the axis of rotation of the gripper shaft so that the mass moment of inertia is not too great. Furthermore, the grippers should be able to be exchanged easily since they are subject to wear, and they should be adjustable in terms of their holding force.

A sheet gripper of the type specified is disclosed in Belluche U.S. Pat. No. 2,395,444. Such a sheet gripper comprises a continuous steel strip of uniform cross-section forming a gripper arm, a bent-back spring region and a circular arc-shaped clip for attachment of the spring region to the gripper shaft. The clip encloses a circumferential angle of nearly 360°. In the Belluche sheet gripper, the bent spring region is located between the gripper shaft and the outer contour of the impression cylinder. To keep the spring region from projecting beyond the outer contour, the gripper shaft must be arranged a corresponding distance inwardly from the outer contour of the impression cylinder. This results in the gripper tip moving in non-perpendicular relation to the outer surface of the impression cylinder. Instead, the gripper tip moves at an angle relative to the outer surface of the impression cylinder. As a result, the gripper tip can still move in the circumferential direction when it rests on the outer surface of the impression cylinder and is turned even further when the holding force is increased. Furthermore, adjustment of the gripper arm by the clip is difficult, and exchange of the sheet grippers requires the gripper shaft to be dismantled.

A sheet gripper also is disclosed by DE-A-3,623, 405 and comprises a plurality of individual parts, namely, a gripper arm, a carrier, an attachment screw, an adjustment screw and a helical spring. The carrier is screwed to the gripper shaft and, like the gripper arm, extends tangentially relative to the gripper shaft. With the carrier firmly connected to the gripper shaft, the gripper arm can move in a rotating and tilting manner relative to the gripper shaft. The helical spring is located between the carrier and the gripper arm and is prestressed by means of the adjustment screw in order to establish a holding force determined by the setting of the adjustment screw. This arrangement is disadvantageous in that it consists of a plurality of individual parts and is therefore complex in manufacture and difficult to exchange.

Another sheet gripper, likewise consisting of a plurality of parts, is disclosed in German Utility Model 8,404,981. Attached to a basic body, which is firmly connected to the gripper shaft, is a leaf spring which forms the gripper arm.

The leaf spring projects beyond the basic body and includes a tip which forms the gripper tip. The leaf spring rests on an adjusting screw which is screwed into the basic body. By adjusting the adjusting screw relative to the basic body, the prestress of the leaf spring can be varied. The basic body consists of a block-like part which rests on one side of a spindle and is held by a strap which engages around the spindle. In this arrangement, the angular position of the gripper tip disadvantageously changes depending on the deflection of the leaf spring.

SUMMARY OF THE INVENTION

The general object of the present invention is to provide a sheet gripper of the above type which is simple in construction and can be mounted and demounted easily without need of dismantling the gripper shaft from the impression cylinder. Furthermore, the sheet gripper is characterized by a low moment of inertia in order to allow a high operating speed.

This object is achieved according to the invention in that the gripper arm itself is relatively stiff, the sheet gripper including a bent-back spring section and including a gripper tip lying on opposite sides of a plane which is perpendicular to the gripper arm and which extends radially relative to the gripper shaft.

In the sheet gripper according to the invention, the functions of the gripper arm and of the spring section are distinctly separate from one another, and the spring section is arranged in such a way that clearly defined pressing-on conditions result at the gripper tip, the angular change of the gripper tip remaining small when the sheet gripper is pressed through. Slip between the gripper tip and the abutment are largely avoided and a large holding force which can be set within narrow boundaries may be established. By means of the single-part design, the mass of the sheet gripper is relatively small. The small mass and the short distance of the gripper arm from the gripper shaft result in the sheet gripper having a small moment of inertia and thus allow a high operating speed of the machine.

It is particularly advantageous for the gripper arm to extend tangentially relative to the gripper shaft, the distance between the gripper arm and the gripper shaft being considerably shorter at the narrowest point than the opening width of the bent-back spring section. Favorable force and deformation conditions and a balanced mass distribution are obtained due to the fact that the narrowest point between the gripper arm and the gripper shaft lies between the ends of the gripper arm, in particular, between the middle of the gripper arm and the spring section.

In order to be able to mount and exchange the sheet gripper in a simple manner while the gripper shaft is installed, provision is made according to a further aspect of the invention for the bent-back end of the spring section to form an attachment arm which, with a contact surface adapted to the curvature of the surface of the gripper shaft, rests on the side of the gripper shaft facing the gripper arm and is releasably attached there by means of a screw. In this case, the bent spring section preferably encloses an angle of more than 180°, the attachment arm and the gripper arm merging tangentially into the spring section.

The attachment arm preferably has a screw hole for inserting a screw which is to be screwed into the gripper shaft. A washer is expediently provided between the head of the screw and the attachment arm, the washer having a contact surface adapted to the curvature of the attachment arm. In order for the screw to be readily accessible for a tool even when the distance between the gripper arm and the attachment arm is short, a through hole may be provided in the gripper arm above the screw hole. If the through hole must be of large diameter, the gripper arm can be widened in the axial direction of the gripper shaft in order to avoid weakening in the region of the through hole. In order to achieve the greatest possible distance of the gripper shaft from the center of rotation, the gripper arm may be bent toward the gripper shaft. In such a case, the bending point may advantageously be located opposite the attachment point of the attachment arm.

To reinforce the gripper arm, provision may furthermore be made for side walls to be constructed along the side edges of the arm, which side walls extend towards the gripper shaft. The side walls can engage laterally around the attachment arm and, together with the side surfaces of the attachment arm, form a radial guide for the gripper arm. Furthermore, the gripper arm can have contact surfaces, for example on the side walls, with which the gripper arm can be supported on the gripper shaft in the open position. As a result, the spring deflection of the gripper arm relative to the gripper shaft is limited and the swivel angle of the gripper shaft required for opening and closing the sheet gripper can be reduced accordingly.

These and other objects and advantages of the invention will become more apparent from the following detailed description when taken in conjunction with the accompanying drawings.

BRIEF DESCRIPTION OF THE DRAWINGS

FIG. 1 is a partially cut-away side view of a new and improved sheet gripper incorporating the unique features of the invention.

FIG. 2 is a top plan view of the sheet gripper shown in FIG. 1.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

FIG. 1 shows a gripper shaft 1 which is arranged within a longitudinal gap 2 of an impression cylinder. A sheet gripper 3 is of one-piece construction having a plurality of sections with different functions. One section forms a gripper arm 4 which extends approximately tangentially relative to the gripper shaft 1 and whose longitudinal axis lies in a plane perpendicular to the axis of the gripper shaft. At its free end, the gripper arm 4 is bent slightly and defines a gripper tip 5. The latter comes to rest on the outer surface of the impression cylinder in order to hold, at that point, the edge of a sheet (not shown) to be printed. At its other end 6, the gripper arm 4 merges into a bent spring section 7 which encloses an angle range of slightly greater than 180°. The bent spring section 7 has a free end portion defining an attachment arm 8 which bears with a slightly curved end region against the gripper shaft 1. The transitions of the gripper arm 4 and of the attachment arm 8 to the bent spring section 7 run tangentially, i.e., without a sharp bend.

The gripper arm 4 is bent slightly as indicated at 9. The bend 9 is located above the end of the attachment arm 8 screwed to the gripper shaft 1 and lies about a third of the way along the gripper arm 4, measured from the transition point 6 to the gripper tip 5. The gripper arm 4, the bent spring section 7 and the attachment arm 8 consist of a continuous sheet of spring steel which is about 2–3 cm wide and 2–3 mm thick. Other materials can be plastic filled with iron or carbon fibers. In this case, only the bent spring section 7 forms an elastically resilient part which is bent up when the gripper tip 5 comes to rest on the impression cylinder.

The end region of the attachment arm 8 has a screw hole 10 through which a screw 11 passes, the screw being threaded into a tapped radially extending hole in the gripper shaft 1. In order to even out the curved surface of the attachment arm 8, a washer 12 is provided between the head of the screw 11 and the attachment arm 8, the washer being flat on one side and conforming on its other side to the radius of curvature of the attachment arm 8. In this way, the attachment arm and thus the entire gripper can be tightened and held securely. The screw hole 10 is significantly larger than the screw 11 and can be elongated in the circumferential direction. As a result, the sheet gripper 3 can be shifted forwardly or rearwardly by a few degrees in the circumferential direction of the gripper shaft 1 so that precise adjustment of the gripper can take place.

Provided in the gripper arm 4 above the screw 11 is a through hole 13 through which the screw 11 may be inserted and through which a screwdriver may be located. The through hole 13 is elongated in the circumferential direction.

Formed along the side edges of the gripper arm 4 are side walls 14, 15 which are bent downwardly toward the gripper shaft 1. The side walls reinforce the gripper arm 4. Seen in the plan view, the side walls 14, 15 converge toward one another as they progress from the gripper shaft 1 to the ends of the gripper arm 4, such that the width of the gripper arm 4 decreases towards its ends.

At the height of the gripper shaft, the gripper arm 4 can be provided with stop lugs with which it can be supported on the gripper shaft 1. In this way, a prestress of the gripper arm 4 can be achieved.

The gripper arm 4 is so inflexible that the elastic deformation is limited when the gripper tip 5 is pressed on to the bent spring section 7 which is far away from the gripper tip. This results in only a slight angular change of the gripper tip 5 when the sheet gripper 3 is pressed through and results in a better holding force.

As is apparent from the drawings, the sheet gripper 3 is of compact construction, it is easy to mount, has a low moment of inertia, and allows for a long gripper arm. The radial height of the sheet gripper is advantageously low and allows a greater distance of the gripper shaft from the center of rotation.

I claim:

1. A sheet gripping device for a sheet transfer cylinder of a sheet-fed printing machine comprising a gripper shaft mounted for relative rotational movement in a gap formed in an outer periphery of said cylinder, said shaft having a rotary axis disposed in parallel radially spaced relation to a pivot axis of said cylinder, a gripper made of a single piece of resiliently yieldable material, said gripper having a gripper arm with a gripper tip at one end thereof and a spring section integral with the other end of the arm and curving reversely from the arm toward the tip, said spring section defining a bent leaf spring having a free end portion adapted for attachment to said shaft whereby said spring section supports said arm for limited swinging of said tip, said spring section and said tip lying on opposite sides of a plane extending substantially perpendicular to said arm and radially of said shaft whereby said arm remains relatively stiff during swinging of said tip.

2. A sheet gripping device as defined in claim 1 in which said arm is spaced radially from and extends substantially tangentially of said shaft, said spring section being generally C-shaped and having first and second spaced legs, the spacing between said legs being significantly greater than the minimum spacing between said arm and said shaft.

3. A sheet gripping device as defined in claim 1 in which said spring section has first and second legs which encompass an angle of greater than 180 degrees, said arm and said free end portion merging gradually with said first and second legs, respectively.

4. A sheet gripping device for a sheet-processing machine comprising a gripper shaft, a gripper made of a single piece of resiliently yieldable material, said gripper having a gripper arm with a gripper tip at one end thereof and a spring section integral with the other end of the arm and curving reversely from the arm toward the tip, said spring section defining a bent leaf spring having a free end portion curved to conform to an outer peripheral configuration of said shaft, a screw for releasably attaching said free end portion to the outer periphery of said shaft whereby said spring section supports said arm for limited swinging of said tip, said spring section and said tip lying on opposite sides of a plane extending substantially perpendicular to said arm and radially of said shaft whereby said arm remains relatively stiff during swinging of said tip.

5. A sheet gripping device as defined in claim 4 further including a washer between said screw and said free end portion of said spring section and having one side curved in accordance with the curvature of said free end portion.

6. A sheet gripping device as defined in claim 4 further including a screw hole in said free end portion of said spring section for receiving said screw, and a through hole in said arm in alignment with said screw hole whereby said screw may be inserted into said screw hole by way of said through hole.

7. A sheet gripping device as defined in claim 6 in which said arm is widened in the axial direction of said shaft in the region of said through hole.

8. A sheet gripping device as defined in claim 1 in which said arm is bent between its ends with the bending point being located in generally opposing relation to the point of attachment of said free end portion to said shaft.

9. A sheet gripping device as defined in claim 1 in which said arm and tip are disposed in substantially tangential relation to an outer periphery of said cylinder.

10. A sheet gripping device for a sheet-processing machine having a gripper shaft comprising a gripper made of a single piece of resiliently yieldable material and having a gripper arm with a gripper tip at one end thereof, a spring section integral with the other end of the arm and curving reversely from the arm toward the tip, said spring section defining a bent leaf spring having a free end portion adapted for attachment to said shaft, said arm having side edges with walls formed integrally with said side edges and projecting toward said shaft, whereby said spring section supports said arm for limited swinging of said tip, said spring section and said tip lying on opposite sides of a plane extending substantially perpendicular to said arm and radially of said shaft whereby said arm remains relatively stiff during swinging of said tip.

11. A sheet gripping device as defined in claim 10 in which said walls straddle and engage said free end portion of said spring section so as to guide said arm on said free end portion.

* * * * *